US006655994B2

(12) United States Patent
Yamamoto

(10) Patent No.: US 6,655,994 B2
(45) Date of Patent: Dec. 2, 2003

(54) TERMINAL-RETAINMENT CANCELLATION STRUCTURE OF CONNECTOR

(75) Inventor: Masaya Yamamoto, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/140,285

(22) Filed: May 8, 2002

(65) Prior Publication Data

US 2002/0127914 A1 Sep. 12, 2002

Related U.S. Application Data

(63) Continuation of application No. 09/542,289, filed on Apr. 4, 2000.

(30) Foreign Application Priority Data

Apr. 5, 1999 (JP) ..... P. 11-097259

(51) Int. Cl.[7] ..... H01R 13/40
(52) U.S. Cl. ..... 439/595
(58) Field of Search ..... 439/595, 744, 439/871

(56) References Cited

U.S. PATENT DOCUMENTS 5,716,232 A * 2/1998 Endo et al. ..... 439/595
5,769,644 A 6/1998 Saito et al.
5,820,411 A * 10/1998 Okabe ..... 439/595
5,839,921 A * 11/1998 Yamanashi ..... 439/595
6,165,011 A * 12/2000 Fukuda ..... 439/595
6,193,551 B1 * 2/2001 Yamamoto et al. ..... 439/595

FOREIGN PATENT DOCUMENTS

JP 7-14577 3/1995

* cited by examiner

*Primary Examiner*—Renee Luebke
*Assistant Examiner*—Felix O. Figueroa
(74) *Attorney, Agent, or Firm*—Sughrue Mion, PLLC

(57) ABSTRACT

A guide plate (9) for guiding the jig rod (7) extends from a hole (4), formed in a connector (24), toward a distal end of the retaining lance (3). A slanting guide surface (10) for sliding contact with the jig rod (7) is formed on the retaining lance (3). The jig rod (7) is inserted into the hole (4) without shaking. A guide groove (43) for guiding the jig rod (7) is formed in the guide plate (9), and an inner surface (4*a*) of the hole (4) is disposed flush with a guide surface (13) of the guide groove (43). The guide plate (9) extends to a position near to the retaining lance (3). A retaining projection (16) is formed on the retaining lance (3) in juxtaposed relation to the slanting guide surface (10). A press-contact portion (25) for contact with the slanting guide surface (10) and an abutment step portion (22) for contact with the retaining projection are formed at the jig rod (7). A slanting surface (21) for contact with the slanting guide surface (10) is formed at the press-contact portion (25). A front holder (2) is attached to a front end of a connector housing (1), and the hole (4) and the guide plate (9) are provided at the front holder.

5 Claims, 6 Drawing Sheets

TERMINAL-RETAINMENT CANCELLATION STRUCTURE OF CONNECTOR

This is a continuation of application Ser. No. 09/542,289 filed Apr. 4, 2000; the disclosure of which is incorporated herein by reference.

BACKGROUND OF THE INVENTION

1. Field of the Invention

The present invention relates to a terminal-retainment cancellation structure of a connector in which the engagement of a retaining lance, provided within a connector housing, with a terminal can be easily canceled without prying (or prizing) the retaining lance by a jig rod.

The present application is based on Japanese Patent Application No. Hei. 11-97259, which is incorporated herein by reference.

2. Description of the Related Art

FIG. 11 shows a related terminal-retainment cancellation structure of a connector which is disclosed in Unexamined Japanese Utility Model Publication No. Hei. 7-14577.

In this structure, a jig rod 53 is inserted obliquely into a connector housing 51 of a synthetic resin through an opening 52 formed through an upper wall thereof, and an elastic retaining lance 54 is pried (or prized) by this jig rod 53, thereby canceling the engagement between a terminal 55 and the retaining lance 54.

A stop wall 56 is provided adjacent to the upper opening 52, and is disposed in a direction of prying of the retaining lance 54, and this stop wall 56 prevents excessive deformation of the retaining lance 54. A support wall 58, having a short slanting guide surface 57, is provided adjacent to the upper opening 52 at a front end of the connector housing 51. The jig rod 53 is inserted into the connector housing 51 along the guide surface 57 through the opening 52, and is turned on the support wall 58 (serving as a fulcrum) to raise or pry the distal end of the retaining lance 54. Molding holes 60 for molding the retaining lances 54 are formed through a front end wall 59 of the connector housing 51.

Two (upper and lower) rows of terminal receiving chambers 61 are formed within the connector housing 51, and the terminals 55 are received back to back in the upper and lower terminal receiving chambers 61, respectively. The opening 52 is provided outwardly of each terminal receiving chamber 61, and the upper openings 52 and the lower openings 52 are disposed symmetrically. The retaining lance 54 is disposed between the stop wall 56 and the terminal 55. A projection 54*a*, formed on an inner surface of the retaining lance 54 at the distal end thereof, is fitted into an engagement hole in the terminal 55, thereby retaining the terminal 55 against rearward withdrawal. Thus, the connector 62 mainly comprises the connector housing 51 and the terminals 55.

In the above structure, however, the jig rod-inserting openings 52 are formed through the upper and lower outer walls of the connector housing 51, and therefore the terminal receiving chambers 61 could be arranged only in one or two rows (stages), thus inviting a problem that a multi-pole connector, having terminal receiving chambers arranged in a plurality of stages (more than two stages), could not be obtained. And besides, each molding hole 60 for molding the retaining lance is formed through the front end wall 59 of the connector housing 51, and therefore there has been encountered a problem that the operator sometimes inserts the jig rod 53 into the molding hole 60 by mistake, and pries the terminal 55 to deform the same.

FIGS. 12A and 12B show another related terminal-retainment cancellation structure of a connector.

In this structure, a jig rod-inserting hole 67 is formed through a front end wall 66 of a connector housing 65, and aug rod 68 is inserted horizontally into the connector housing 65 through the hole 67 from the front side thereof, and is engaged with a distal end of a retaining lance 69, and then the jig rod 68 is turned on an edge (serving as a fulcrum) of the hole 67 in a direction of arrow B (FIG. 12B) to raise or pry the retaining lance 69, thereby canceling the engagement between a terminal 70 and the retaining lance 69.

A molding hole for molding the retaining lance serves as the jig rod-inserting hole 67, and the hole 67 is considerably large in size. A mating terminal-inserting hole 71 is formed through the front end wall 66 of the connector housing 65, and is disposed at the lower side of the jig rod-inserting hole 67. The terminal 70 is of the female type, and a mating terminal of the male type in a mating connector (not shown) is inserted through the hole 71, and is connected to the terminal 70. In this structure, the terminals 70 can be arranged in a plurality of rows (stages).

In the structure of FIGS. 12A and 12B, however, the large molding hole for molding the retaining lance serves as the jig rod-inserting hole 67, and therefore there has been encountered a problem that the jig rod 68 can not always be inserted into a proper position, and therefore it has been difficult to accurately pry the retaining lance 69. And besides, the jig rod 68 is brought into engagement with the retaining lance 69 in a fumbling manner, and the retaining lance 69 is pried in a fumbling manner, and therefore there has been encountered a problem that the retaining lance 69 and the terminal 70 are liable to be damaged. In this structure and the structure of FIG. 11, the jig rod 53, 68 is turned by leverage, and therefore an unduly-large force is liable to be applied, which leads to a possibility that the retaining lance 54, 69 is pressed hard against the outer wall 56, 72 of the connector housing 51, 65, and is deformed. And besides, the jig rod 53, 68 is first inserted into the connector housing 51, 65, and then the retaining lance is pried by the jig rod, and thus the two operations are required, and this has invited a problem that the retainment-canceling operation is cumbersome.

SUMMARY OF THE INVENTION

With the above problems in view, it is an object of the present invention to provide a terminal-retainment cancellation structure of a connector in which terminals can be arranged in a plurality of rows (stages), and a jig rod can accurately approach a retaining lance, and the retaining lance can be accurately flexed (elastically deformed) with a simple operation without deforming (permanently deforming) and damaging the retaining lance.

To achieve the above object, according to the first aspect of the present invention, there is provided a connector which comprises a connector housing into which a jig rod is insertable through a hole, an elastic retaining lance, by which a terminal is retained, formed within the connector housing, the retaining lance which is flexed in a retainment-canceling direction by the jig rod inserted through the hole, a guide plate attachable into the connector housing so as to extend from the hole toward a distal end of the retaining lance, the guide plate which guides the jig rod inserted from the hole, and a slanting guide surface, with which a distal end of the jig rod is brought into sliding contact, formed on the distal end portion of the retaining lance.

Further, according to the second aspect of the present invention, it is preferable that the hole is formed to stabilize an insertion of the jig rod without shaking.

Further, according to the third aspect of the present invention, it is preferable that a guide groove is formed in the guide plate to guide an insertion of the jig rod, and an inner surface of the hole is flush with a guide surface of the guide groove.

Further, according to the fourth aspect of the present invention, it is preferable that the guide plate extends to a position near to the distal end of the retaining lance.

Further, according to the fifth aspect of the present invention, it is preferable that the connector further comprises a retaining projection formed on the retaining lance in juxtaposed relation to the slanting guide surface.

Further, according to the sixth aspect of the present invention, it is preferable that the jig rod includes, at the distal end thereof, a press-contact portion brought into contact with the slanting guide surface, and an abutment step portion brought into contact with a front end surface of the retaining projection.

Further, according to the seventh aspect of the present invention, it is preferable that a slanting surface is formed on the press-contact portion, and wherein the slanting surface is brought into contact with the slanting guide surface of the retaining lance.

Further, according to the eighth aspect of the present invention, it is preferable that the connector further comprises a front holder attachable to a front end of the connector housing, the front holder including the hole and the guide plate.

DETAILED DESCRIPTION OF THE PREFERRED EMBODIMENTS

A preferred embodiment of the present invention will now be described in detail with reference to the drawings.

Figure 1:
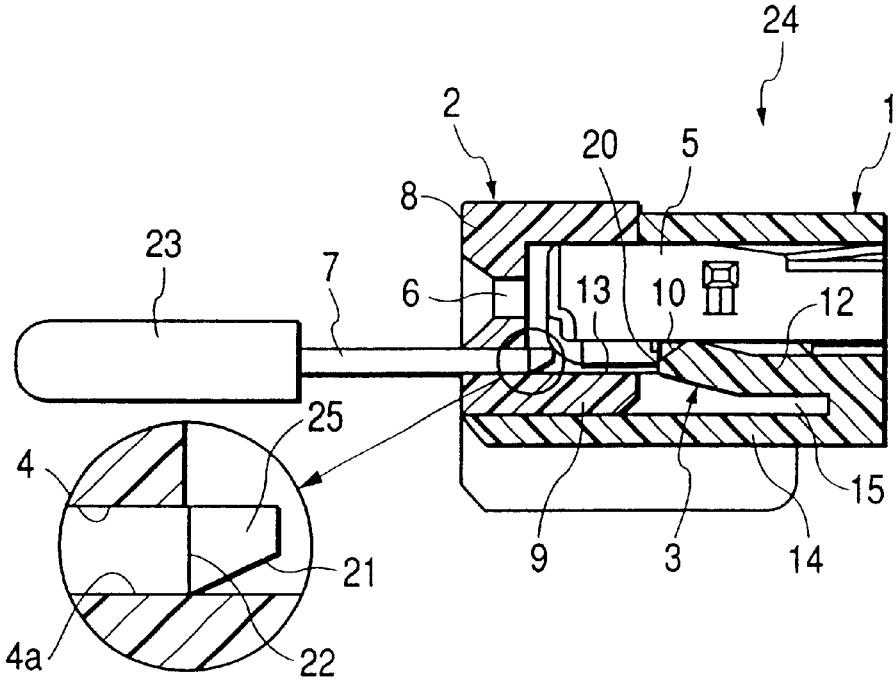
FIG. 1 is a vertical cross-sectional view showing a terminal-retainment cancellation structure of a connector forming one preferred embodiment of the present invention.
Figure 2:
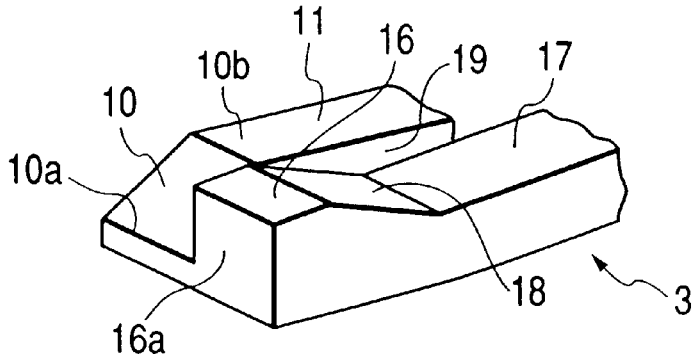
FIG. 2 is a perspective view showing a retaining lance.
Figure 3:
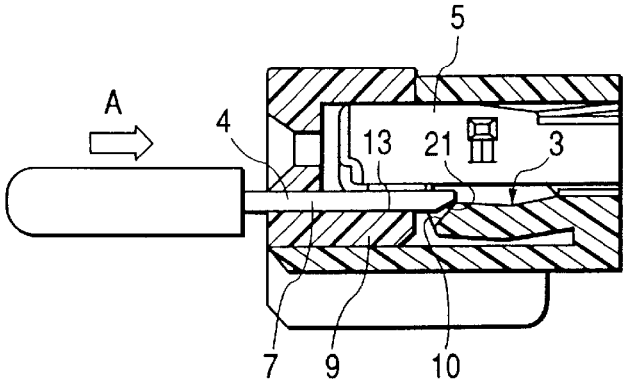
FIG. 3 is a vertical cross-sectional view showing a condition in which the retainment of a terminal is canceled.

FIGS. 1 to 3 show a terminal-retainment cancellation structure of a connector forming one preferred embodiment of the present invention.

As shown in FIG. 1, a front holder 2, made of a synthetic resin, is provided at a front end of a connector housing 1 made of a synthetic resin. A jig rod-inserting hole 4 and a mating terminal-inserting hole 6 are formed in the front holder 2. A jig rod can be passed through the jig rod-inserting hole 4 to be engaged with an elastic retaining lance 3 provided within the connector housing 1, and a mating terminal can be passed through the mating terminal-inserting hole 6 to be connected to a terminal 5 received in the connector housing 1.

The jig rod-inserting hole 4 has an inner diameter corresponding to the outer diameter of the jig rod 7. More specifically, the inner diameter of the hole 4 is slightly larger than the outer diameter of the jig rod 7. The hole 4 is disposed in opposed relation to the distal (front) end of the retaining lance 3. An axis or centerline (not shown) of the hole 4 is disposed parallel to an axis (centerline) of a horizontal straight portion 12 of the retaining lance 3. The hole 4 has a length equal to the thickness of a front end wall 8 of the front holder 2, and extends perpendicularly from the front end wall 8. The inner diameter and length of the hole 4 are so determined that the hole 4 can support the jig rod 7 without allowing the shaking of the jig rod 7.

A guide plate 9 extends from the front holder 2 toward the distal end of the retaining lance 3, and an upper surface of this guide plate 9 is flush with a lower inner surface 4*a* of the hole 4. A line (not shown) of extension of the guide plate 9 is disposed parallel to a line (not shown) of extension of the straight portion 12 of the retaining lance 3. The guide plate 9 extends straight to a position near to the distal end of the retaining lance 3. The guide plate 9 is disposed perpendicularly to the front end wall 8 of the front holder 2, and is much longer (about twice longer) than the hole 4. The hole 4 and the guide plate 9 extend in a direction perpendicular to the direction of flexing of the retaining lance 3.

As best shown in FIG. 2, a slanting guide surface 10 is formed on the distal end portion of the retaining lance 3. The slanting guide surface 10 is opposed to the jig rod-inserting hole 4 (FIG. 1). A front end 10*a* of the slanting guide surface 10 is disposed very near to the lower surface of the retaining lance 3. Namely, the distal end portion of the retaining lance 3 is formed into a wedge-shape because of the provision of the slanting guide surface 10. Therefore, the distal end of the jig rod 7 can be positively brought into contact with the slanting guide surface 10.

A rear end 10*b* of the slanting guide surface 10 substantially coincides with the top of the retaining lance 3, and a rear slanting surface 11 extends from the rear end 10*b* at a gradient opposite to that of the slanting guide surface 10, and this slanting surface 11 is continuous with the upper surface of the straight portion 12 (FIG. 1) which is the proximal portion of the retaining lance 3. As shown in FIG. 1, the straight portion (proximal portion) 12 is disposed on a line of extension of the guide surface (upper surface) 13 of the guide plate 9, and is integral with the connector housing 1. A lance flexure space 15 is formed between the retaining lance 3 and a lower outer wall 14 of the connector housing 1. The guide plate 9 is inserted into the connector housing 1 in contiguous relation to the inner side of the outer wall 14, and the distal end of the guide plate 9 is disposed in opposed relation to the lance flexure space 15.

As shown in FIG. 2, the retaining lance 3 has an integral retaining projection 16 of a trapezoidal or a rectangular shape formed at one side of the slanting guide surface 10 in parallel or juxtaposed relation thereto. The retaining projection 16 is continuous with a straight portion 17 via a rear slanting surface 18, and the slanting surface 18 and the straight portion 17 are continuous with the slanting surface 11 (extending rearwardly from the slanting guide surface 10) and the straight portion 12 (FIG. 1) via a step portion 19, and are juxtaposed thereto. The retaining projection 16 is engaged with a step portion 20 (FIG. 1) formed at the lower side of the terminal 5 (FIG. 1), thereby retaining the terminal 5 against rearward withdrawal. The top of the retaining projection 16 is disposed at a height or level substantially equal to or slightly higher than the top or apex (10*b*) of the slanting guide surface 10. When the retaining lance 3 is viewed from the front side, the slanting guide surface 10 is disposed at one side portion of the retaining lance 3 in the direction of the width thereof whereas the retaining projection 16 is disposed at the other side portion thereof.

As shown in FIG. 1, a press-contact portion 25 having a slanting surface 21 for contact with the slanting guide surface 10 of the retaining lance 3, as well as an abutment step portion 22 for contact with a front (distal) end surface 16*a* of the retaining projection 16, is formed at the distal end of the jig rod 7. A grip 23 of a larger diameter is provided at a rear end of the jig rod 7. Thus, the connector 24 mainly comprises the connector housing 1, the terminals 5 and the front holder 2.

The jig rod 7 is inserted into the hole 4 from the front side of the connector 24, and is advanced straight along the guide surface 13 of the guide plate 9, disposed flush with the inner surface 4*a* of the hole 4, in the direction of the length of the terminal 5 as indicated by arrow A in FIG. 3. In FIG. 3, the jig rod 7 is held in intimate contact with the guide plate 9 and the inner surface 4*a* (FIG. 1) of the hole 4 over a large proportion of the entire length thereof since the inner diameter of the hole 4 is generally equal to the outer diameter of the jig rod 7.

The jig rod 7 is inserted toward the slanting guide surface 10 of the retaining lance 3 without shaking. Then, the distal end of the jig rod 7, that is, the downwardly-directed slanting surface 21, is brought into sliding contact with the upwardly-directed slanting guide surface 10, and presses and flexes the retaining lance 3 downwardly into the flexure space 15. As a result, the engagement of the retaining projection 16 (FIG. 2) with the step portion 20 of the terminal 5 is canceled. The jig rod 7 is thus inserted straight into the connector housing 1, and with this one operation, the retaining lance 3 is positively pressed down, thereby canceling the retainment of the terminal 5. By pulling a wire (not shown), connected to the terminal 5, rearwardly in the inserted condition of the jig rod 7, the terminal 5 can be withdrawn from the connector housing.

Figure 4:
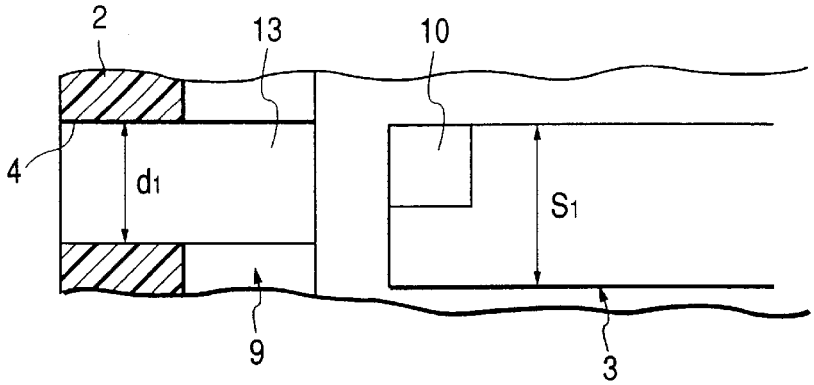
FIG. 4 is a top plan view showing the construction of the retaining lance and the construction of a jig rod-inserting hole.
Figure 5:
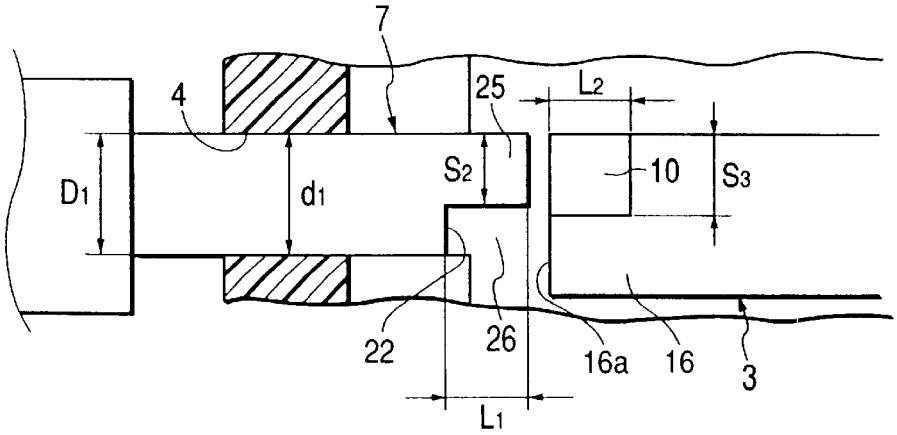
FIG. 5 is a top plan view showing the construction of the retaining lance and the construction of a jig rod.
Figure 6:
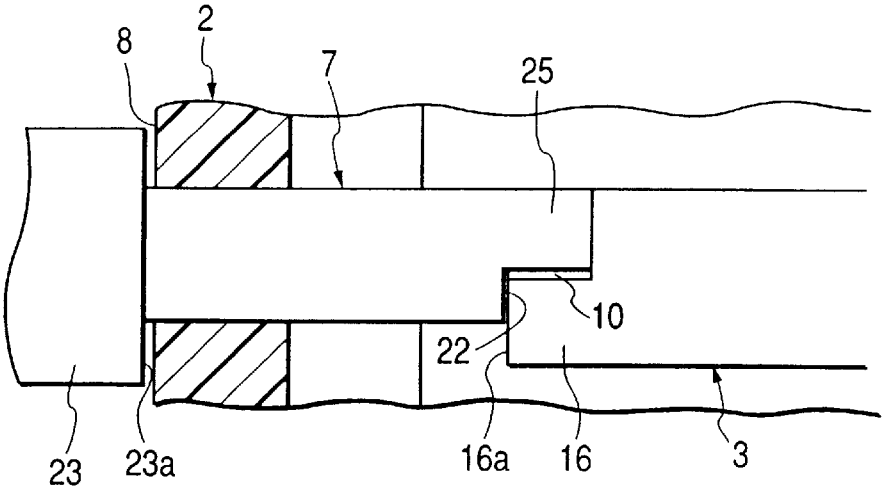
FIG. 6 is a top plan view showing a condition in which the retaining lance is flexed by the jig rod.

FIGS. 4 to 6 are views (top plan views) showing the constructions of the retaining lance 3 and jig rod 7.

As shown in FIG. 4, the inner surface 4*a* of the jig rod-inserting hole 4 (In this embodiment, the hole 4 has a rectangular shape) in the front holder 2 lies flush with the guide surface 13 of the guide plate 9, and is continuous with the guide surface 13, and has the same width as that of this guide surface 13. The axis or centerline (not shown) of the hole 4 is slightly offset toward the slanting guide surface 10. The width $S_1$ of the retaining lance 3 is larger than the inner diameter (width) $d_1$ of the hole 4, and the retaining lance 3 has the uniform width $S_1$ over the entire length thereof.

As shown in FIG. 5, the outer diameter $D_1$ of the jig rod 7 is generally equal to the inner diameter $d_1$ of the hole 4 (Exactly speaking, the inner diameter $d_1$ of the hole 4 is slightly larger). The press-contact portion 25 for contact with the slanting guide surface 10 of the retaining lance 3 is formed at the distal end of the jig rod 7 in a projected manner, and a rectangular notch is formed at one side of the press-contact portion 25. The length $L_1$ of the press-contact portion 25 is substantially equal to the length $L_2$ of the slanting guide surface 10, and the width $S_2$ of the press-contact portion 25 is slightly smaller than the width $S_3$ of the slanting guide surface 10. An end surface of the notch 26, formed adjacent to the press-contact portion 25, that is, the abutment step portion 22, is opposed to the vertical front end surface 16*a* of the retaining projection 16 of the retaining lance 3 in parallel relation thereto.

As shown in FIG. 6, the press-contact portion 25, formed at the distal end of the jig rod 7, is brought into sliding contact with the slanting guide surface 10 of the retaining lance 3 to press the retaining lance 3 downwardly, thereby canceling the retainment of the terminal 5 (FIG. 3), and in this condition the end surface of the notch 26, that is, the abutment step portion 22, abuts against the front end surface 16*a* of the retaining projection 16 of the retaining lance 3. Therefore, the jig rod 7 can not be further pushed into the connector housing 7, and the retaining lance 3 is prevented from being excessively flexed, thus preventing the deformation of the retaining lance 3.

A front end surface 23*a* of the grip 23 can abut against the front end wall 8 of the front holder 2 simultaneously when the abutment step portion 22 of the jig rod 7 abuts against the front end surface 16*a* of the retaining lance 3, and with this construction the retaining lance 3 is prevented from being unnecessarily pressed in the longitudinal direction.

FIGS. 7 to 10 show another embodiment of the present invention including a connector housing 31, in which the terminals 5 (FIG. 3) can be received in a plurality of rows (stages), and a front holder 32. Those constituent portions identical to those of FIG. 1 will be designated by identical reference numerals, respectively.

Figure 7:
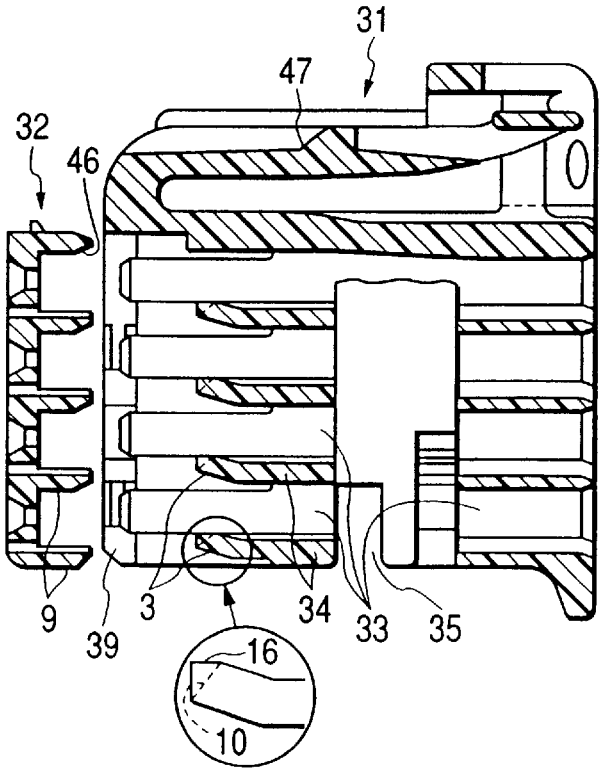
FIG. 7 is a vertical cross-sectional view showing a connector housing and a front holder of the present invention.

As shown in FIG. 7, a plurality of (four in this embodiment) rows (stages) of terminal receiving chambers 33 are formed within the connector housing 31 made of a synthetic resin. An elastic retaining lance 3 is formed integrally with a bottom wall 34 of each terminal receiving chamber 33, and is disposed on a line of extension of the bottom wall 34. The retaining lance 3 serves as part of the bottom wall 34. An insertion hole 35 for receiving a terminal double-retaining spacer (not shown) is formed in the connector housing, and is disposed generally centrally of the length of the terminal receiving chambers 33.

Openings 36 (FIG. 8), each having generally the same width as that of the terminal receiving chamber 33, are formed in a front end of the connector housing 31, and are disposed forwardly of the retaining lances 3, respectively. Each opening 36 serves also as a molding hole for molding the retaining lance 3.

Figure 8:
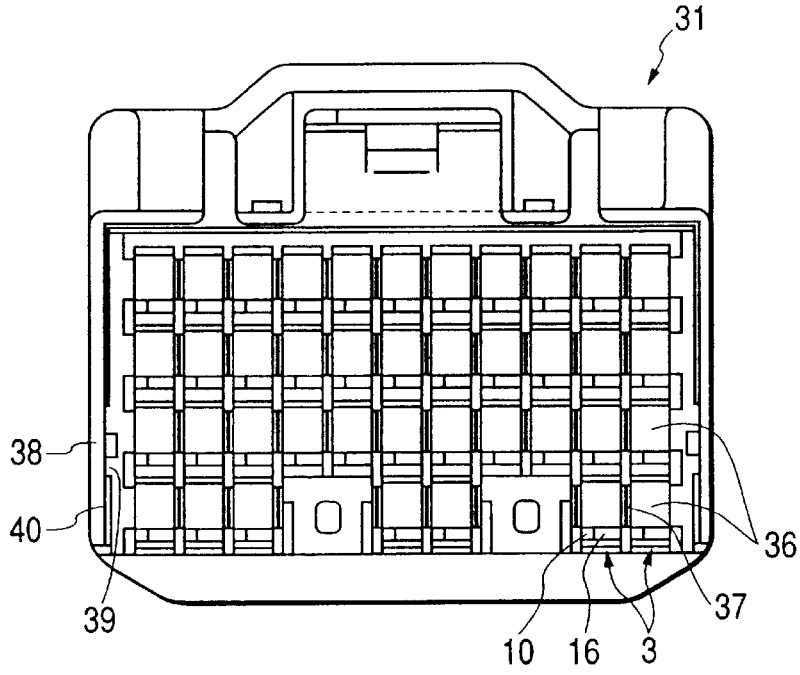
FIG. 8 is a front-elevational view of the connector housing.
Figure 9:
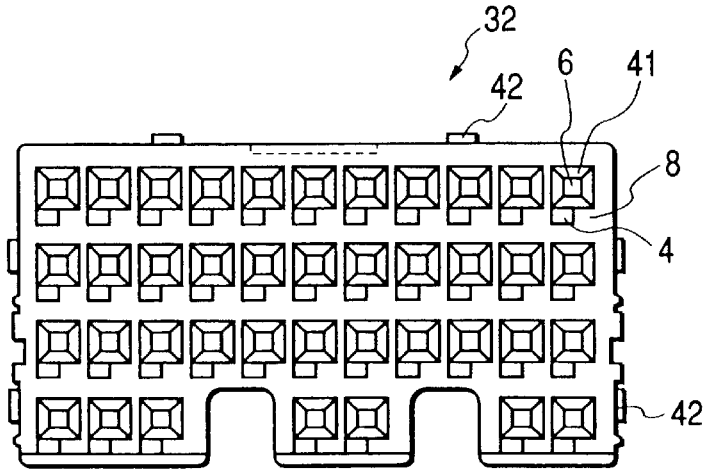
FIG. 9 is a front-elevational view of the front holder.

Each row of terminal receiving chambers 33 are separated from one another by partition walls 37 (FIG. 8), and a lower end of each partition wall 37 is disposed at the same level as that of an upper end of the corresponding lance 3. As described above with reference to FIG. 2, the retaining lance 3 has a slanting guide surface 10 (FIG. 8) and a retaining projection 16 which are juxtaposed to each other in a direction of the width of the retaining lance 3. A large opening 39 is formed in the front end of the connector housing 31, and is surrounded by a peripheral wall 38 (FIG. 8), and the front holder 32 of FIG. 9 is fitted into the opening 39. Retaining portions 40 for retaining the front holder 32 are formed on a peripheral edge of the opening 39.

As shown in FIG. 9, a plurality of (or an array of) terminal-inserting holes 6, corresponding respectively to the terminal receiving chambers 33 (FIG. 7), are formed in a front end wall 8 of the front holder 32. A tapering guide surface 41 for a male terminal in a mating connector (not shown) is formed around each hole 6. Engagement projections 42 for being engaged respectively with the retaining portions 40 of the connector housing 31 (FIG. 8) are formed on an peripheral edge of the front end wall 8. An array of jig rod-inserting holes 4 of a rectangular shape are formed in the front end wall 8, and are disposed at the lower sides of the terminal-inserting holes 6, respectively. Each hole 4 is disposed in offset relation to the corresponding terminal-inserting hole 6, and is directed toward the slanting guide surface 10 of the corresponding retaining lance 3 (FIG. 8).

Figure 10:
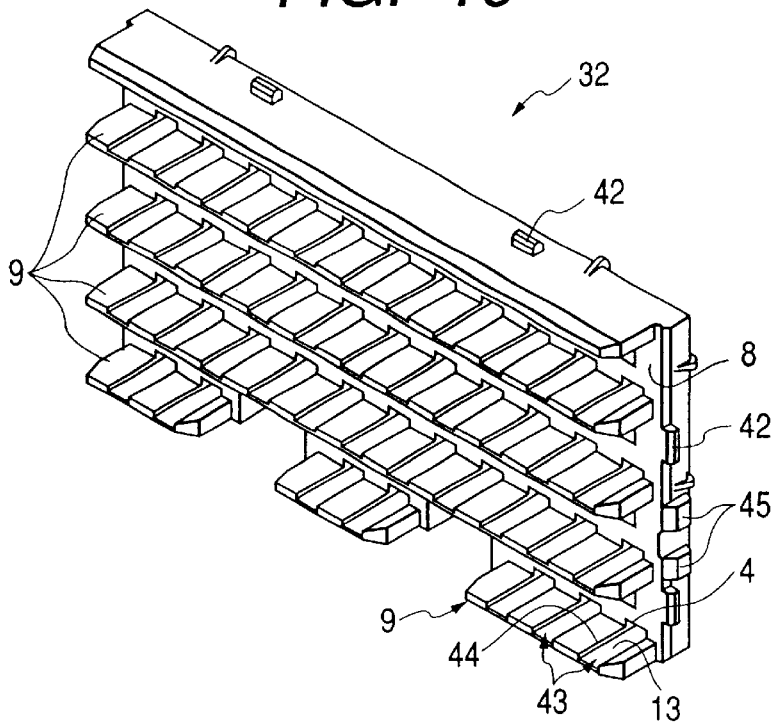
FIG. 10 is a perspective view of the front holder.
Figure 11:
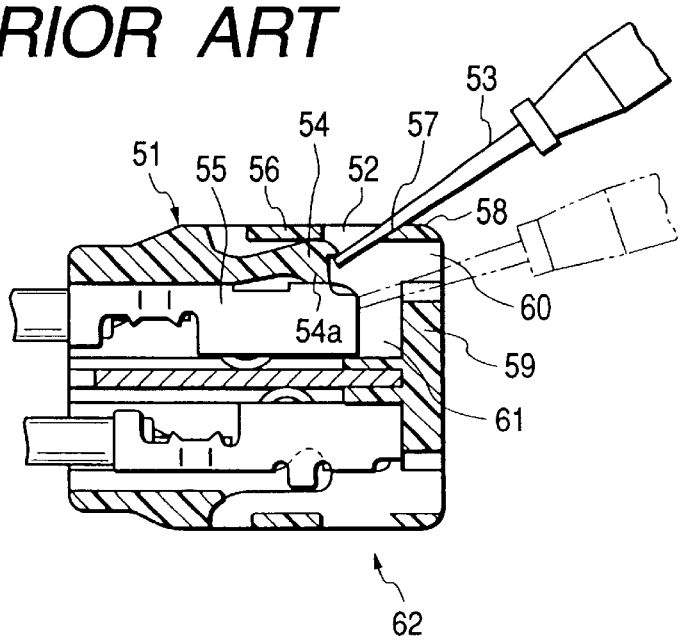
FIG. 11 PRIOR ART
FIG. 11 is a vertical cross-sectional view of a related construction.
Figure 12A:
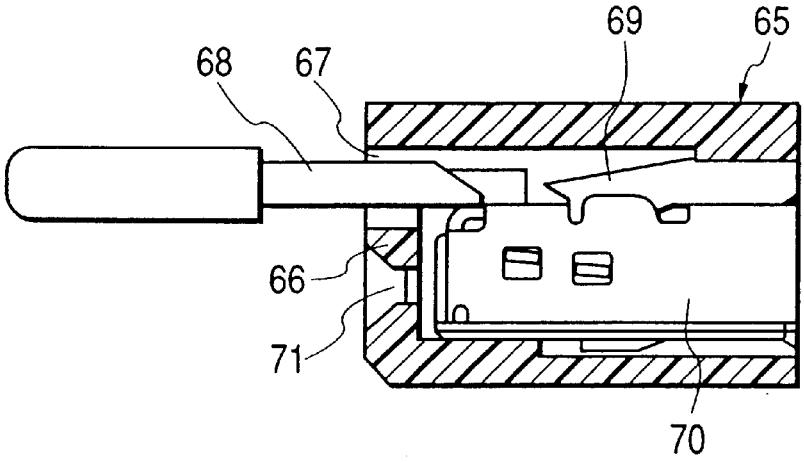
FIG. 12A PRIOR ART
FIGS. 12A and 12B are vertical cross-sectional views of another related construction, showing the operation in sequence.
Figure 12B:
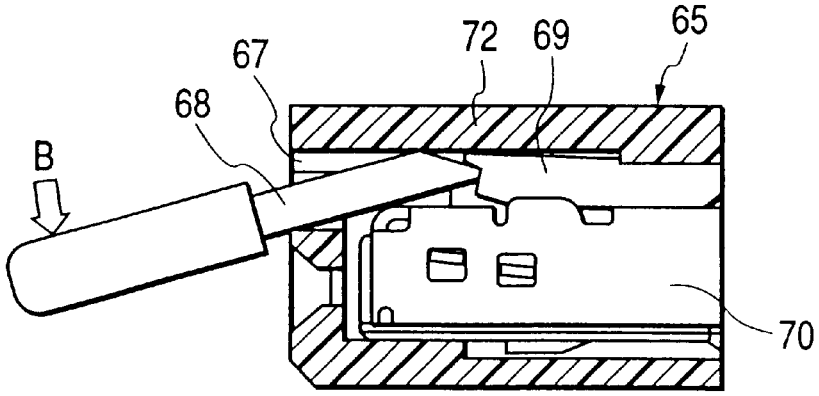
FIG. 12B PRIOR ART

As shown in FIG. 10, a plurality of rows (stages) of jig rod guide plates 9 are formed on and project from the reverse surface of the front end wall 8 of the front holder 32. Each guide plate 9 is disposed at the lower portions of the corresponding row of jig rod-inserting holes 4, and extends continuously in the direction of the width of the front end wall 8. Each guide plate 9 projects perpendicularly from the front end wall 8, and is disposed horizontally.

Guide grooves 43 of a channel-shaped cross-section are formed in each guide plate 9, and are aligned with the corresponding jig rod-inserting holes 4, respectively, the guide groove 43 having a width equal to the width of the hole 4. A guide surface 13, defined by a bottom surface of each guide groove 43, is continuous with a lower inner surface of the corresponding hole 4, and is disposed flush therewith. Opposite side surfaces of the guide groove 43 extend straight from opposite side surfaces of the hole 4, respectively. The guide groove 43 extends straight from the hole 4 to a distal end (rear end) of the guide plate 9. In FIG. 10, reference numeral 42 denotes the engagement projections for engagement with the connector housing 31 (FIG. 8), and reference numeral 45 denotes positioning guide projections.

The guide plates 9 of the front holder 32 are inserted into the connector housing 31 through the front end opening 39 thereof toward the corresponding retaining lances 3. A slanting surface 46 is formed on the lower surface of each guide plate 9 at the distal end thereof so as to facilitate the insertion of the guide plate. When the front holder 32 is attached to the connector housing 31, each guide plate 9 is disposed near to the front ends of the corresponding retaining lances 3 in opposed relation thereto in such a manner that the guide plate 9 is slightly offset downwardly with respect to these retaining lances 3, as shown in FIG. 1. Thereafter, the jig rod 7 is inserted into the connector housing 31 to flex the retaining lance 3 in a retainment-canceling direction to thereby cancel the retainment of the terminals 5 (FIG. 3), and this operation is the same as described above with reference to FIGS. 1 to 6, and therefore explanation thereof will be omitted here.

In the connector housing 31 of the multi-stage, multi-pole type shown in FIG. 7, there is not provided a lower outer wall, corresponding to the lower outer wall 14 of FIG. 1. A lock arm 47 for a mating connector housing of the female type is formed on the upper surface of the connector housing 31. The connector housing 31 of this embodiment is of the male type. Thus, the multi-stage, multi-pole connector mainly comprises the connector housing 31, the front holder 32 and the terminals 5.

The slanting surface 21 (FIG. 1), formed at the distal end of the jig rod 7, serves to more smoothly bring the jig rod 7 into sliding contact with the slanting guide surface 10 of the retaining lance 3. Without this slanting surface 21, however, the distal end of the jig rod 7, the distal end of the jig rod 7 can be brought into sliding contact with the slanting guide surface 10 to flex the retaining lance 3 in the retainment-canceling direction in so far as the retaining lance 3 has the slanting guide surface 10. In this embodiment, the jig rod 7 has a rectangular cross-section, and can be brought into surface-to-surface contact with the guide plate 9 so as to enhance the linearly-advancing ability, thereby preventing the jig rod 7 from being improperly positioned relative to the retaining lance 3. However, a jig rod (not shown) of a circular cross-section and jig rod-inserting holes 4 of a circular cross-sections can be used, in which case the holes 4 have an inner diameter substantially equal to the outer diameter of the jig rod, and have a sufficient length.

In the retaining lance 3, the retaining projection 16 and the slanting guide surface 10 are juxtaposed to each other as shown in FIG. 2, and the retainment of the terminal 5 and the retainment cancellation are effected separately from each other, thereby enhancing the reliability of the retainment and the retainment cancellation. However, the apex 10*b* of the slanting guide surface 10 can have the function of a retaining projection so that the terminal 5 (FIG. 1) can be retained by the apex 10*b*. In this case, the width of such a retaining lance 3 is reduced generally by half, and this contributes to a widthwise compact, fine-pitch design of the connector housing 1. The connector housing 1 is not limited to the multi-stage type as in FIG. 7, but can be of the single-stage type, and the front holder (2; 32) can be formed in accordance with the configuration of the connector housing (1; 31).

The front holder (2; 32) may be formed integrally with the connector housing (1; 31) if this is possible in the resin molding technique, and in this case jig rod-inserting holes 4 and guide plates 9 are provided at the connector housing (not shown) integral with the front holder. The retaining lances 3 may be separate from the connector housing (1; 31), in which case the retaining lances 3 are formed, for example, on a spacer (not shown). The definitions of the upward and downward directions in this specification are limited to the illustrated embodiments, and the upper and lower positions can be inverted 180 degrees or 90 degrees, depending on the condition of use of the connector 24.

As described above, in the present invention, the jig rod is passed through the hole, and is positively guided straight toward the distal end of the retaining lance by the guide plate, and the distal end of the jig rod is brought into sliding contact with the slanting guide surface of the retaining lance to flex the retaining lance in the retainment-canceling direction. Therefore, the retainment of the terminal can be easily and positively canceled merely by the insertion of the jig rod (one operation). The retaining lance does not need to be pried as in the related construction, and therefore the retaining lance is positively prevented from damage and deformation. And besides, the hole is provided in opposed relation to the distal end of the retaining lance, and therefore the terminals can be arranged in a plurality of rows (stages) within the connector.

In the present invention, the jig rod will not shake in the hole, and therefore the direction of insertion of the jig rod is accurately defined, and the distal end of the jig rod can accurately approach the distal end of the retaining lance. Therefore, the jig rod does not need to be operated in a fumbling manner, so that the retaining lance and the terminal will not be damaged and deformed by the jig rod. In the present invention, the jig rod is accurately guided toward the retaining lance along the guide groove, and therefore the retaining lance and the terminal are positively prevented from damage and deformation. In the present invention, the possibility that the jig rod is improperly positioned between the guide plate and the retaining lance is reduced to a minimum, and therefore the jig rod can more accurately approach the retaining lance.

In the present invention, the retainment of the terminal is positively effected by the retaining projection which is independent of the slanting guide surface, and therefore the terminal-retaining force is increased. In the present invention, the press-contact portion flexes the retaining lance in the retainment-canceling direction to cancel the retainment of the terminal, and in this condition, the abutment step portion abuts against the retaining projection, thereby preventing the jig rod from being further pushed into the connector housing. Therefore, the retaining lance is prevented from being excessively flexed, thereby positively preventing the deformation of the retaining lance. In the present invention, the slanting surface of the jig rod is smoothly brought into sliding contact with the slanting guide surface of the retaining lance, and therefore the retainment-canceling operation can be easily effected with a small force. In the present invention, the holes are formed in the front holder separate from the connector housing, the jig rod-inserting holes of a small diameter can be provided regardless of large molding holes for molding the retaining lances, and therefore the above effects are achieved. More specifically, the jig rod will not shake in the hole, and the direction of insertion of the jig rod is accurately defined, and the distal end of the jig rod can accurately approach the distal end of the retaining lance. Therefore, the jig rod does not need to be operated in a fumbling manner as in the related construction, and therefore the jig rod will not damage and deform the retaining lance and the terminal. The guide plates are formed on the separate front holder, and with this construction each of the holes is completely continuous with the guide plate, with no joint formed therebetween, and therefore the jig rod can be smoothly inserted, and can be accurately positioned.

What is claimed is:

1. A connector system, comprising a connector including:

a connector housing;

an elastic retaining lance, by which a terminal is retained, formed in the connector housing, wherein the retaining lance is flexed in a retainment-canceling direction by a jig rod inserted into the connector housing;

a retaining projection, for retaining the terminal, formed at a distal end of the retaining lance; and a slanting guide surface, for canceling a retainment between the retaining lance and the terminal, on which a distal end of the jig rod slides and which is formed at the distal end of the retaining lance and juxtaposed to the retaining projection in a lance width direction perpendicular to the retainment-canceling direction; and the jig rod, wherein a recess is formed at the distal end of the jig rod so as not to interfere with the retaining projection when the jig rod is inserted into the connector housing.

2. The connector system according to claim 1, wherein the retaining projection includes a front end surface for the retainment.

3. The connector system according to claim 2, wherein the connector housing is provided at a front side thereof with a front holder including a hole into which the jig rod is inserted, and the hole is aligned with the slanting guide surface.

4. The connector system according to claim 1, wherein the connector housing is provided at a front side thereof with a front holder including a first hole into which the terminal is inserted and a second hole into which the jig rod is inserted, and the first hole is offset to the second hole.

5. A connector system:

the connector according to claim 1, further comprising the terminal, wherein a step for engaging with the retaining projection is formed at an end portion of the terminal.

* * * * *